US008353417B1

(12) United States Patent
Wu

(10) Patent No.: US 8,353,417 B1
(45) Date of Patent: Jan. 15, 2013

(54) MULTI-PURPOSE FLOATABLE CONTAINER HAVING A LINKAGE DISC FOR LATERALLY SECURING AN ADDITIONAL CONTAINER

(76) Inventor: Pin-Chien Wu, Taichung (TW)

( * ) Notice: Subject to any disclaimer, the term of this patent is extended or adjusted under 35 U.S.C. 154(b) by 42 days.

(21) Appl. No.: 13/135,413

(22) Filed: Jul. 5, 2011

(51) Int. Cl.
*B65D 21/028* (2006.01)

(52) U.S. Cl. ..... 220/23.4; 24/287; 206/504; 206/512; 220/1.5; 220/23.6; 220/218; 220/324; 220/560; 410/77; 410/81

(58) Field of Classification Search ..... 24/287; 206/504, 512; 220/1.5, 1.6, 23.4, 23.6, 23.83, 220/23.86, 218, 324, 560; 410/77, 81
See application file for complete search history.

(56) References Cited

U.S. PATENT DOCUMENTS

| | | | | | |
|---|---|---|---|---|---|
| 2,974,822 | A | * | 3/1961 | Trimble | 220/218 |
| 3,052,941 | A | * | 9/1962 | Abolins et al. | 24/287 |
| 3,294,420 | A | * | 12/1966 | Martin | 280/418.1 |
| 3,389,663 | A | * | 6/1968 | Gutridge | 410/82 |
| 3,546,753 | A | * | 12/1970 | Lafont | 24/287 |
| 3,599,824 | A | * | 8/1971 | Pneuman et al. | 220/23.4 |
| 3,691,595 | A | * | 9/1972 | Backteman et al. | 24/287 |
| 3,711,902 | A | * | 1/1973 | Eggert, Jr. | 24/287 |
| 3,749,273 | A | * | 7/1973 | Wreghitt et al. | 220/1.5 |
| 3,752,511 | A | * | 8/1973 | Racy | 24/287 |
| 3,894,493 | A | * | 7/1975 | Strecker | 24/287 |
| 3,973,684 | A | * | 8/1976 | Di Martino | 206/512 |
| 4,082,052 | A | * | 4/1978 | Looks | 410/82 |
| 4,196,673 | A | * | 4/1980 | Looks | 410/89 |
| 4,202,460 | A | * | 5/1980 | Imbeault | 220/218 |
| 4,212,251 | A | * | 7/1980 | DiMartino | 24/287 |
| 4,294,185 | A | * | 10/1981 | Nordstrom et al. | 114/75 |
| 4,427,127 | A | * | 1/1984 | Kalkowski | 220/218 |
| 4,591,307 | A | * | 5/1986 | Clive-Smith | 410/83 |
| 4,626,155 | A | * | 12/1986 | Hlinsky et al. | 410/82 |
| 4,729,707 | A | * | 3/1988 | Takahashi | 411/389 |
| 4,741,449 | A | * | 5/1988 | Bersani | 220/1.5 |
| 4,813,542 | A | * | 3/1989 | Thompson et al. | 206/504 |
| 4,819,820 | A | * | 4/1989 | Weiner | 220/1.5 |
| 4,856,150 | A | * | 8/1989 | Johnson | 24/287 |
| 4,942,975 | A | * | 7/1990 | Capron et al. | 220/23.4 |
| 4,993,125 | A | * | 2/1991 | Capron et al. | 24/287 |
| 5,074,427 | A | * | 12/1991 | Siemerink et al. | 220/218 |
| 5,193,253 | A | * | 3/1993 | Janke et al. | 24/287 |
| 5,454,673 | A | * | 10/1995 | DiMartino | 410/79 |
| 5,548,877 | A | * | 8/1996 | Nitsche | 24/287 |
| 6,113,305 | A | * | 9/2000 | Takaguchi | 403/321 |
| 6,336,765 | B1 | * | 1/2002 | Watanabe | 403/325 |

(Continued)

*Primary Examiner* — J. Gregory Pickett
*Assistant Examiner* — Ned A Walker
(74) *Attorney, Agent, or Firm* — William E. Pelton, Esq.; Cooper & Dunham LLP

(57) ABSTRACT

A multi-purpose floatable container includes a casing, a cap, at least one linkage disc, and at least one buckling bolt. The casing has four corners and each corner has a linking groove, an upper hole, an upper enlarged hole, and a lower hole. The at least one linkage disc is partially and respectively inserted into at least one of the linking grooves. Each one of the at least one linkage disc has four connecting orifices longitudinally defined through the linkage disc. Each one of the at least one buckling bolt is inserted into the top hole of one of the corners, the upper hole, the connecting orifice, and the lower hole for fixing the cap on the casing. The container can be utilized as a single unit for storing objects in the casing. Multiple containers can also be assembled to form a floating platform for diversified purposes.

7 Claims, 14 Drawing Sheets

U.S. PATENT DOCUMENTS 6,363,586 B1 * 4/2002 Neufingerl ..... 24/287
6,519,816 B1 * 2/2003 Tagaguchi et al. ..... 24/287
6,725,507 B2 * 4/2004 Reynard ..... 24/287
7,374,056 B2 * 5/2008 Linares ..... 220/1.5
7,546,666 B2 * 6/2009 Malchow ..... 24/287
2010/0051624 A1 * 3/2010 Finn et al. ..... 220/560

* cited by examiner

MULTI-PURPOSE FLOATABLE CONTAINER HAVING A LINKAGE DISC FOR LATERALLY SECURING AN ADDITIONAL CONTAINER

BACKGROUND OF THE INVENTION

1. Field of the Invention

The present invention relates to a container, and more particularly to a floatable container serving multiple purposes.

2. Description of Related Art

A conventional container includes a casing, a cap buckled on the casing and a space defined in the container for receiving objects.

However, the conventional container does not have a connecting mechanism to link with another conventional container such that the conventional container is individually utilized and is not able to be assembled with other conventional containers to form a floating platform assembly or a raft. Therefore, the conventional container cannot provide diversified functions.

To overcome the shortcomings, the present invention tends to provide a floatable container to mitigate or obviate the aforementioned problems.

SUMMARY OF THE INVENTION

The main objective of the invention is to provide an improved multi-purpose floatable container, which includes a casing, a rectangle cap, at least one linkage disc, and at least one buckling bolt.

The casing has a rectangular bottom plate and a wall.

The wall surrounds an edge of the bottom plate and upwardly extends from the bottom plate. The wall has an abutting edge surroundingly disposed on a top of the wall, outwardly extending from the top of the wall, and being in a rectangular annular shape such that the abutting edge has four abutting surfaces and four corners. Each abutting surface is disposed between the adjacent two corners of the abutting edge. Each corner of the abutting edge has an insert portion formed on the corner. Each insert portion has a linking groove, an upper hole, an upper enlarged hole, and a lower hole.

The linking groove is defined in the insert portion.

The upper hole is formed as an olivary shape, and defined through a top of the insert portion and an inner surface of the linking groove. The upper hole has a major axis defined in the upper hole and imaginatively extending to meet an adjacent abutting surface at a 45-degree angle.

The upper enlarged hole is defined in the inner surface of the linking groove, located adjacent to the upper hole, and communicates the upper hole with the linking groove such that an inner diameter of the upper enlarged hole is equal to or greater than a maximum diameter of the upper hole.

The olivary lower hole is defined through a bottom of the insert portion and the inner surface of the linking groove, aligns with the upper hole, and communicates with the linking groove. The lower hole has a major axis defined in the lower hole and imaginatively extending to meet an adjacent abutting surface at a 45-degree angle.

The cap is mounted on a top of the casing. The cap has four buckling portions respectively disposed on four corners of the cap for corresponding to the four insert portions of the abutting edge. Each buckling portion has a top hole, two buckling seats, and two slopes.

The top hole is defined through the buckling portion, aligns with the upper hole of a corresponding one of the insert portions, and has an olivary shape corresponding to that of the upper holes.

The two buckling seats are formed on two sides of the top hole, and respectively located adjacent to a minor axis of the top hole for facing each other.

The two slopes are respectively formed on two ends of each of the buckling seats.

The at least one linkage disc is partially and respectively inserted into at least one of the linking grooves. Each one of the at least one linkage disc has four connecting orifices longitudinally defined through the linkage disc for selectively aligning to one of the upper holes. Each connecting orifice has an olivary shape corresponding to that of each of the upper holes and selectively communicates with the upper hole and the lower hole of one of the insert portions. Two major axes of adjacent two of the connecting orifices are perpendicular to each other.

The at least one buckling bolt is mounted on the casing. Each one of the at least one buckling bolt is inserted into the top hole of one of the buckling portions, the upper hole aligning to the top hole, the connecting orifice of one of the at least one linkage disc aligning to the upper hole, and the lower hole aligning to the upper hole.

Each one of the at least one buckling bolt has a shank, an elongated knob, an elongated bottom blocker, and an elongated middle blocker.

The knob is disposed on a top of the shank and has two ends radially extending from the buckling bolt toward two opposite directions to form an olivary shape being same as that of each top hole for selectively buckling the two buckling seats of each of the buckling portions. The knob has a major axis defined in the knob.

The bottom blocker is disposed on a bottom of the shank, has two ends radially extending from the shank toward two opposite directions, and has an olivary shape being same as that of each top hole such that the bottom blocker has a major axis defined in the bottom blocker to imaginatively meet that of the knob at 45 degrees in a longitudinal direction of the shank for buckling a bottom surface of a corresponding insert portion.

The middle blocker is disposed between the bottom blocker and the knob, has two ends radially extending from the shank toward two opposite directions, and has an olivary shape being same as that of each upper hole such that the middle blocker is able to be received in a corresponding upper enlarged hole for buckling an inner top surface of the upper enlarged hole. Other objects, advantages and novel features of the invention will become more apparent from the following detailed description when taken in conjunction with the accompanying drawings.

DETAILED DESCRIPTION OF PREFERRED EMBODIMENT

Figure 1:
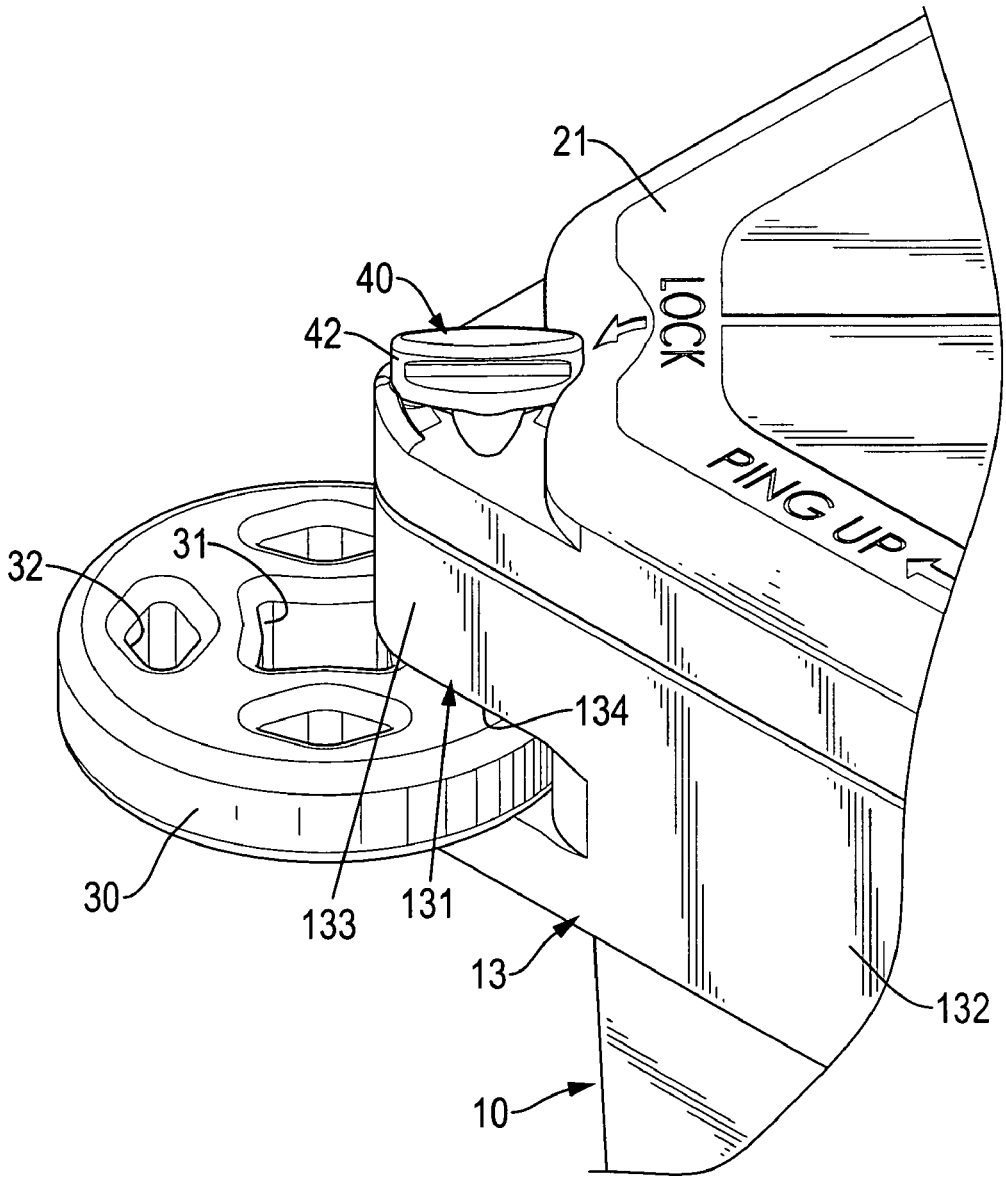
FIG. 1 is a partially perspective view of a multi-purpose floatable container in accordance with the present invention.
Figure 2:
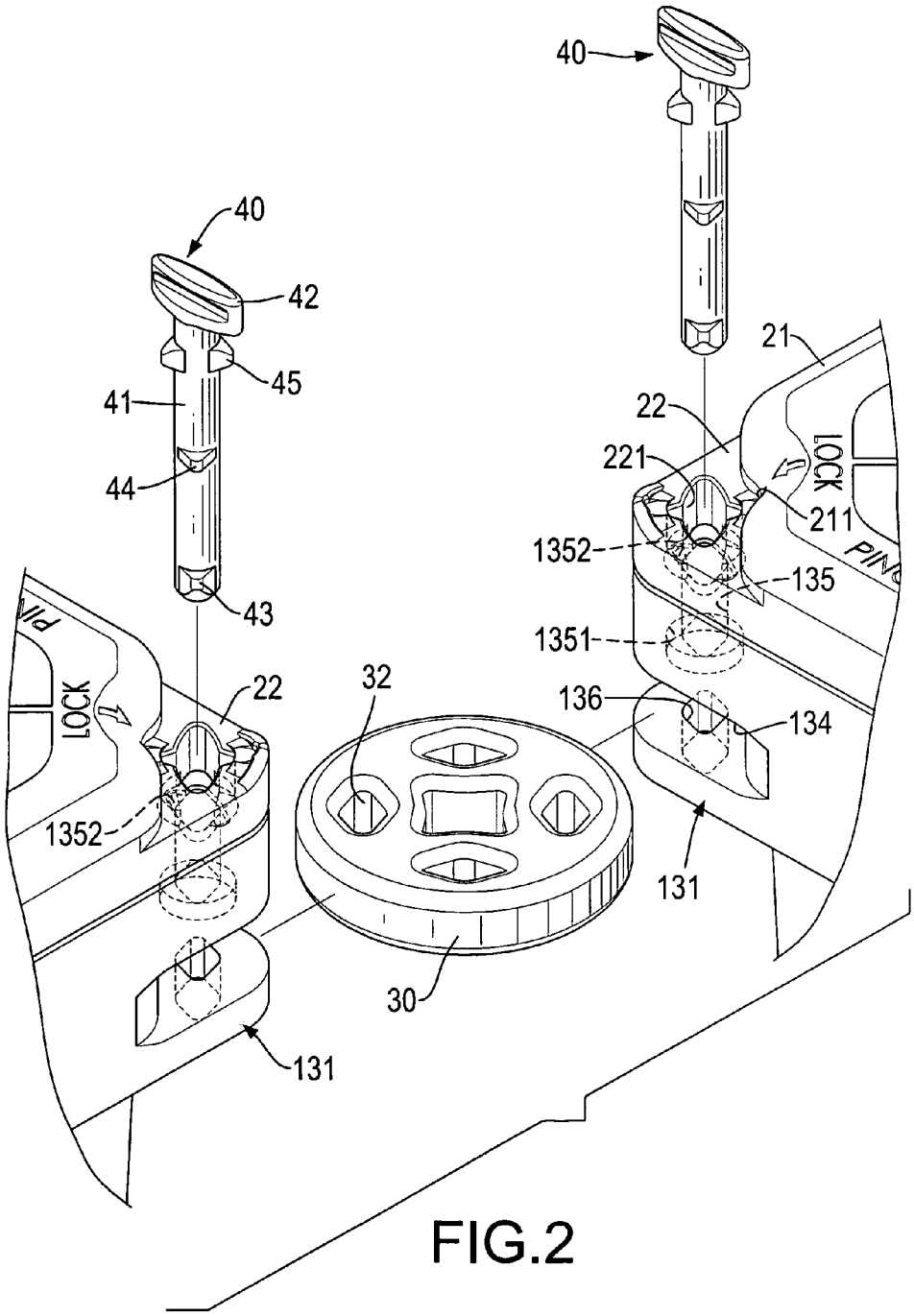
FIG. 2 is an exploded perspective view showing an assembly of multiple floatable containers in FIG. 1.

With reference to FIGS. 1 to 6, the multi-purpose floatable container of the present invention comprises a casing 10, a cap 21, at least one linkage disc 30 and at least one buckling bolt 40.

The casing 10 has a rectangular bottom plate 11 and a wall 12. The wall 12 surrounds an edge of the bottom plate 11 and upwardly extends from the bottom plate 11. The wall 12 is tapered toward a bottom of the wall 12 such that an enclosed area at a top of the wall 12 is greater than an enclosed area at the bottom of the wall 12.

The wall 12 has an abutting edge 13 surroundingly disposed on the top of the wall 12 and outwardly extending from the top of the wall 12. The abutting edge 13 is in a rectangular annular shape to form a sealing collar 14 upwardly extending from the abutting edge 13, and has four abutting surfaces 132 and four curved corners 133. Each abutting surface 132 is disposed between adjacent two of the corners 133 of the abutting edge 13. The sealing collar 14 is located along the abutting edge 13 adjacent to the abutting surfaces 132 such that the sealing collar 14 is formed as a rectangular annular shape. Each corner 133 of the abutting edge 13 has an insert portion 131 formed on the corner 133.

Each insert portion 131 has a linking groove 134, an upper hole 135, a lower hole 136, an elongated positioning hole 1352, and an upper enlarged hole 1351. The linking groove 134 is defined in the insert portion 131. The upper hole 135 is defined through a top of the insert portion 131 and an inner surface of the linking groove 134. The lower hole 136 is defined through a bottom of the insert portion 131, aligned to the upper hole 135, and communicates with the linking groove 134. The elongated positioning hole 1352 is defined through the insert portion 131, crosses and communicates with the upper hole 135. The upper enlarged hole 1351 is defined in the inner surface of the linking groove 134, located adjacent to the upper hole 135, and communicates the upper hole 135 with the linking groove 134 such that an inner diameter of the upper enlarged hole 1351 is equal to or greater than a maximum diameter of the upper hole 135.

Figure 3:
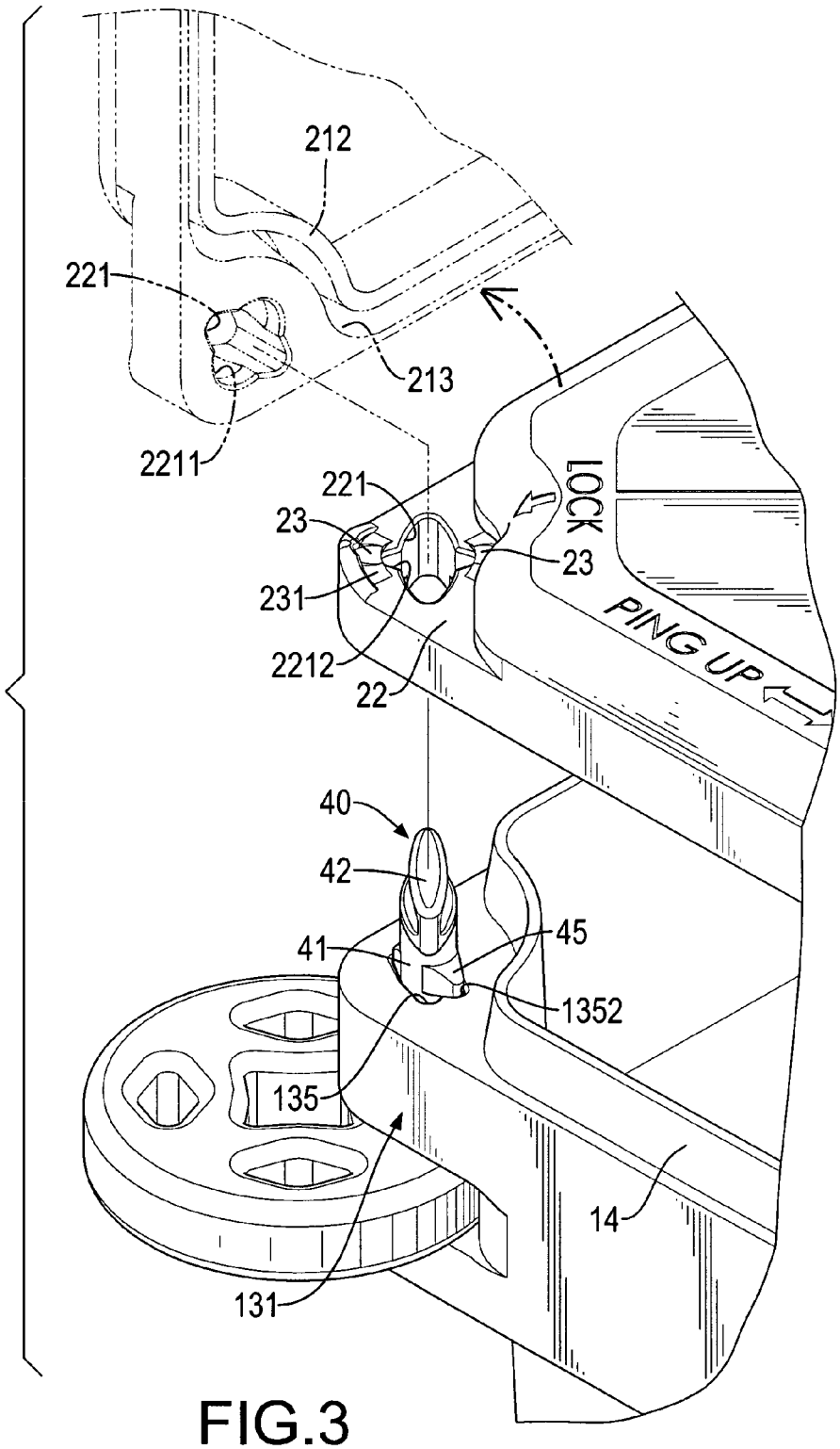
FIG. 3 is an exploded perspective view of the multi-purpose floatable container in FIG. 1.
Figure 3B:
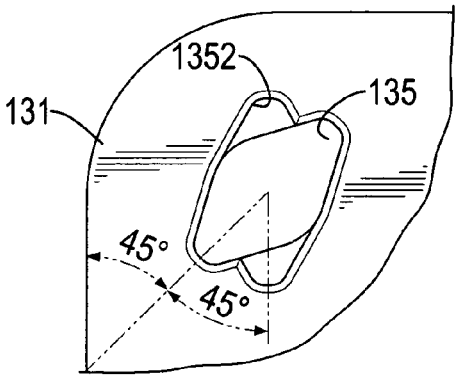
FIG. 3B is a partial view showing an angle of a major axis of a positioning hole relative to that of a crossed upper hole in FIG. 3.
Figure 3A:
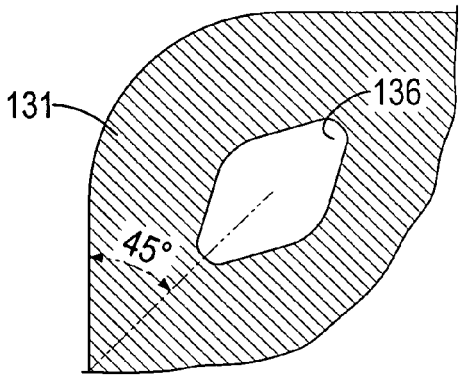
FIG. 3A is a partial view showing an angle of a major axis of a upper/lower hole relative to an adjacent abutting surface in FIG. 3.

Each of the upper holes 135 and the aligned lower holes 136 is formed as an olivary shape. With reference to FIG. 3A, the upper hole 135 has a major axis imaginatively extending to meet any one of the two adjacent abutting surfaces 132 at a forty-five-degree angle, and the lower hole 136 has a major axis imaginatively extending to meet any one of the two adjacent abutting surfaces 132 at a forty-five-degree angle. With reference to FIG. 3B, each positioning hole 1352 is formed as an olivary shape, which is same as that of the upper hole 135, such that the positioning hole 1352 has a major axis imaginatively meeting the major axis of the crossed upper hole 135 at a forty-five-degree angle. The cap 21 is mounted on a top of the casing 10. The cap 21 is in a rectangular shape and has four depressions 211, an inner collar 212, and a sealing slot 213. The four depressions 211 are respectively defined in four corners of the cap 21. Each depression 211 has a middle part inwardly indented. The inner collar 212 downwardly extends from a bottom of the cap 21 and surrounds the bottom of the cap 21. The sealing slot 213 is defined between the inner collar 212 and an inner bottom surface for tightly receiving the sealing collar 14 of the casing 10. The four depressions 211 have four buckling portions 22 respectively outwardly extending from bottoms of the depressions 211 for corresponding respectively to the four insert portions 131 of the abutting edge 13. Each buckling portion 22 is a flat plate and has an outer surface aligned with an outer surface of a corresponding insert portion 131.

Each buckling portion 22 has a top hole 221, two buckling seats, and two slopes 231. The top hole 221 is defined through the buckling portion 22. The two buckling seats 23 are respectively formed on two sides of the top hole 221, and respectively located adjacent to two ends of a minor axis of the top hole 221 such that the two buckling seats 23 face to each other. Each buckling seat 23 protrudes from the buckling portion 22 such that the adjacent two slopes 231 are inclined from the buckling seat 23 toward the buckling portion 22. The two slopes 231 are respectively formed on two ends of each of the buckling seats 23. Each top hole 221 corresponds to and aligns with the upper hole 135 of a corresponding insert portion 131 and has an olivary shape corresponding to that of the aligned upper hole 135. A width and a length of each of the top holes 221 are respectively greater than those of each of the upper holes 135. Each top hole 221 has a rounded top enlarged hole 2211 and two auxiliary holes 2212. The rounded top enlarged hole 2211 is defined in a bottom of the cap 21, and aligns to and communicates with the top hole 221. The two auxiliary holes 2212 are defined through the buckling portion 22, are respectively located on two sides of the top hole 221, and communicate with the top enlarged hole 2211. Each of the auxiliary holes 2212 is tapered toward an outer end of the auxiliary hole 2212.

Figure 3C:
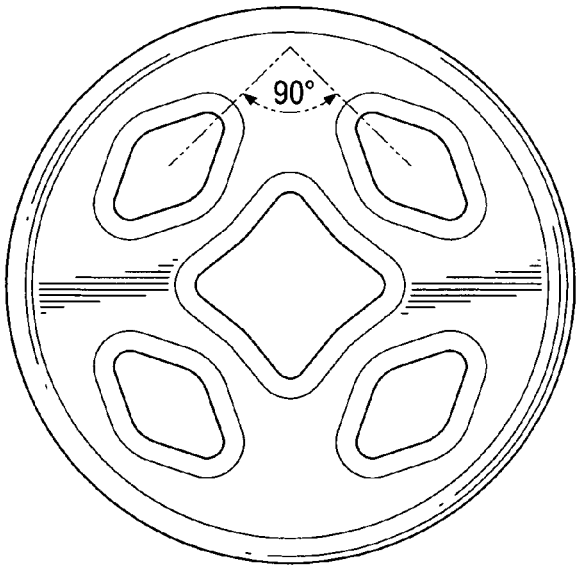
FIG. 3C is a partial view showing an angle of two major axes of adjacent two connecting orifices relative to each other in FIG. 3.
Figure 4:
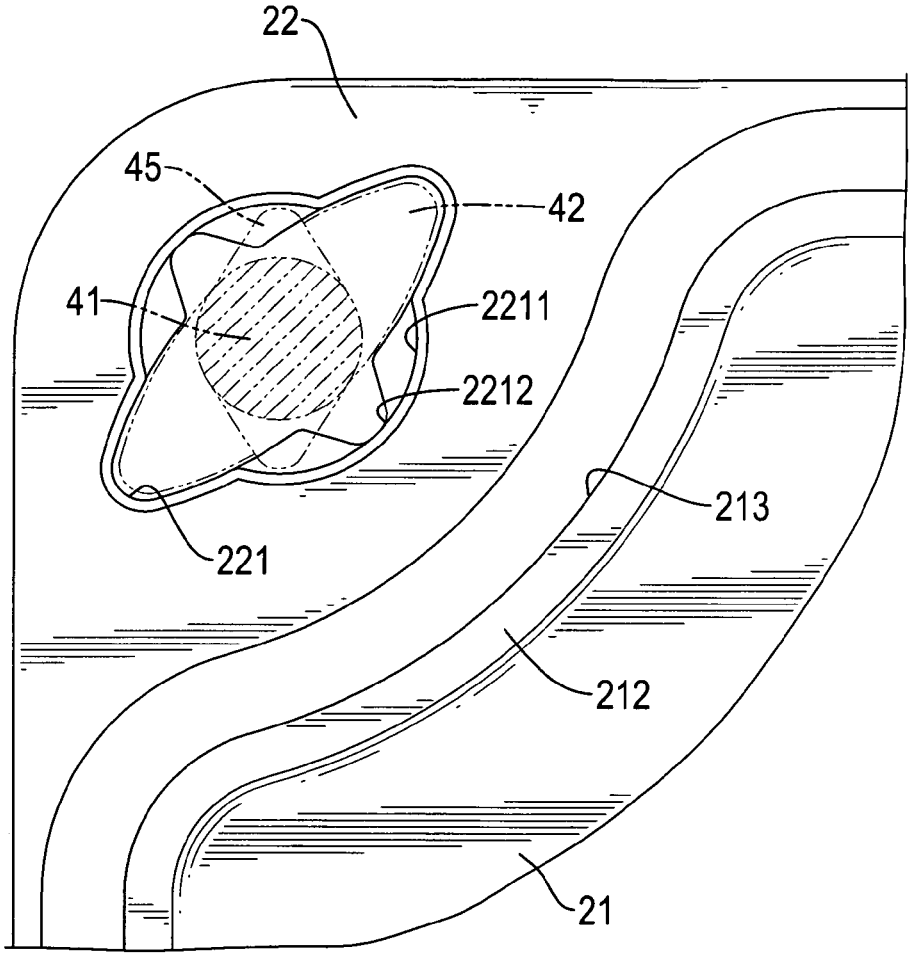
FIG. 4 is a partially bottom view of a cap of the multi-purpose floatable container in FIG. 1.

The at least one linkage disc 30 is partially inserted respectively into at least one of the linking grooves 134. Each linkage disc 30 has a thickness being equal to a width of the linking groove 134, a square central orifice 31 axially defined through a center of the linkage disc 30, and four connecting orifices 32 longitudinally defined through the linkage disc 30 and arranged around the central orifice 31. Each connecting orifice 32 has an olivary shape corresponding to that of each of the upper holes 135 for selectively communicating with the upper hole 135 and the lower hole 136 of one of the insert portions 131. With reference to FIG. 3C, two major axes of adjacent two of the connecting orifices 32 imaginatively extend and are perpendicular to each other.

Each one of the at least one buckling bolt 40 is inserted into the top hole 221 of one of the buckling portions 22, the upper hole 135 aligning to the top hole 221, the connecting orifice 32 of one of the at least one linkage disc 30 aligning to the upper hole 221, and the lower hole 136 aligning to the upper hole 221 for respectively locking one of the at least one linkage disc 30. Each buckling bolt 40 has a shank 41, an elongated knob 42, an elongated bottom blocker 43, an elongated middle blocker 44, and an elongated upper blocker 45.

The knob 42 is disposed on a top of the buckling bolt 40. The knob 42 has two ends radially extending from the shank 41 toward two opposite directions to form an olivary shape being same as that of each top hole 221 for buckling the knob 42 on the two buckling seats 23 of each of the buckling portions 22. The knob 42 extends along a direction being perpendicular to an axis of the shank 41. One of the two ends of the knob 42 is provided for selectively buckling on the middle part of an adjacent depression 211.

The bottom blocker 43 is disposed on a bottom of the buckling bolt 40. The bottom blocker 43 has two ends radially extending from the shank 41 toward two opposite directions and has an olivary shape being same as that of each top hole 221, such that a major axis of the bottom blocker 43 and that of the knob 41 imaginatively meet at a 45-degree angle in a longitudinal direction of the shank 41 for buckling a bottom surface of a corresponding insert portion 131.

The middle blocker 44 is disposed between the bottom blocker 43 and the knob 42. The middle blocker 44 has two ends radially extending from the shank 41 toward two opposite directions and has an olivary shape being same as that of each upper hole 135 to be received in a corresponding upper enlarged hole 1351 for buckling an inner top surface of the upper enlarged hole 1351.

Figure 6:
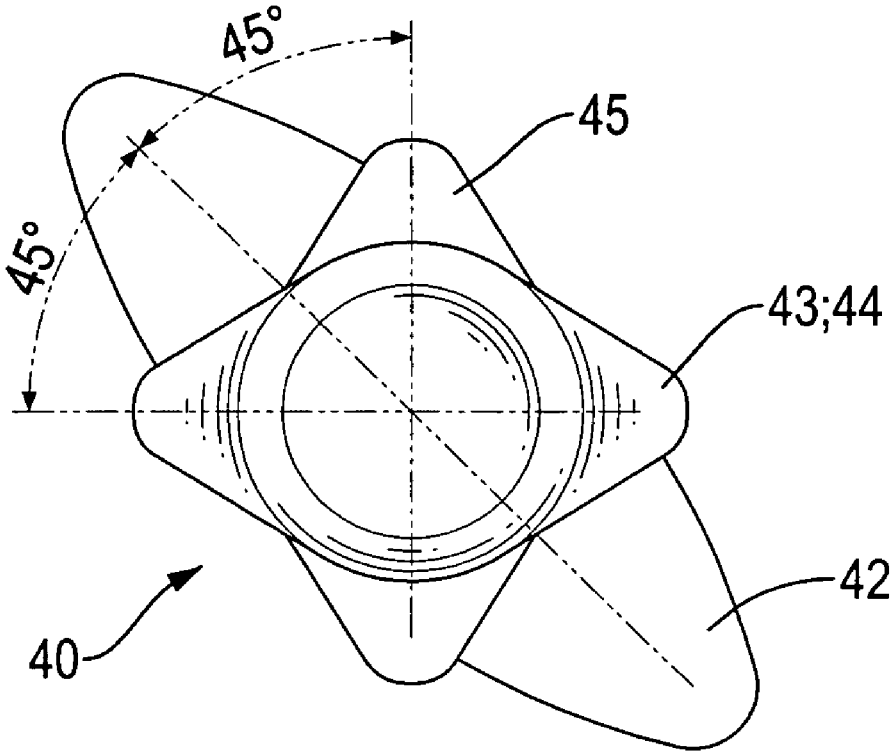
FIG. 6 is a top view showing a buckling bolt of the multi-purpose floatable container in FIG. 1.

The upper blocker 45 is disposed between the knob 42 and the middle blocker 44. With reference to FIG. 6, the upper blocker 45 is positioned adjacent to the knob 42, has two ends radially extending from the shank 41 toward two opposite directions, and has an olivary shape to fit with the two auxiliary holes 2212 of the corresponding buckling portion 22 such that the upper blocker 45 has a major axis defined in the upper blocker 45, imaginatively meeting the major axis of the knob 42 at a forty-five-degree angle in a longitudinal direction of the shank 41, and imaginatively meeting the major axis of the middle blocker 44 at a forty-five-degree angle in a longitudinal direction of the shank 41 for buckling with an inner top surface of the top enlarged hole 2211.

Preferably, the two buckling seats 23 can be omitted, such that the knob 42 of the at least one buckling bolt 40 is downwardly buckled on a top surface of the buckling portion 22 which is located on two sides of the corresponding top hole 221. When the knob 42 with the corresponding buckling bolt 40 are rotated at ninety degrees, the knob 42 is able to align with the corresponding top hole 221 such that the bottom of the knob 42 falls into the top hole 221.

Figure 5A:
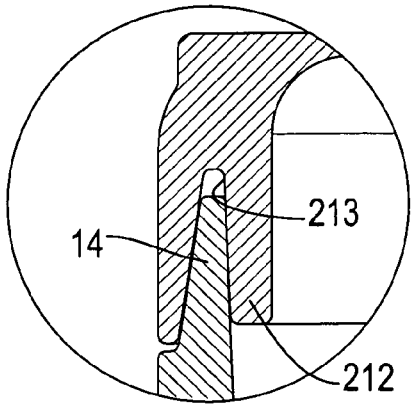
FIG. 5A is an enlarged view of the multi-purpose floatable container in FIG. 5.
Figure 5:
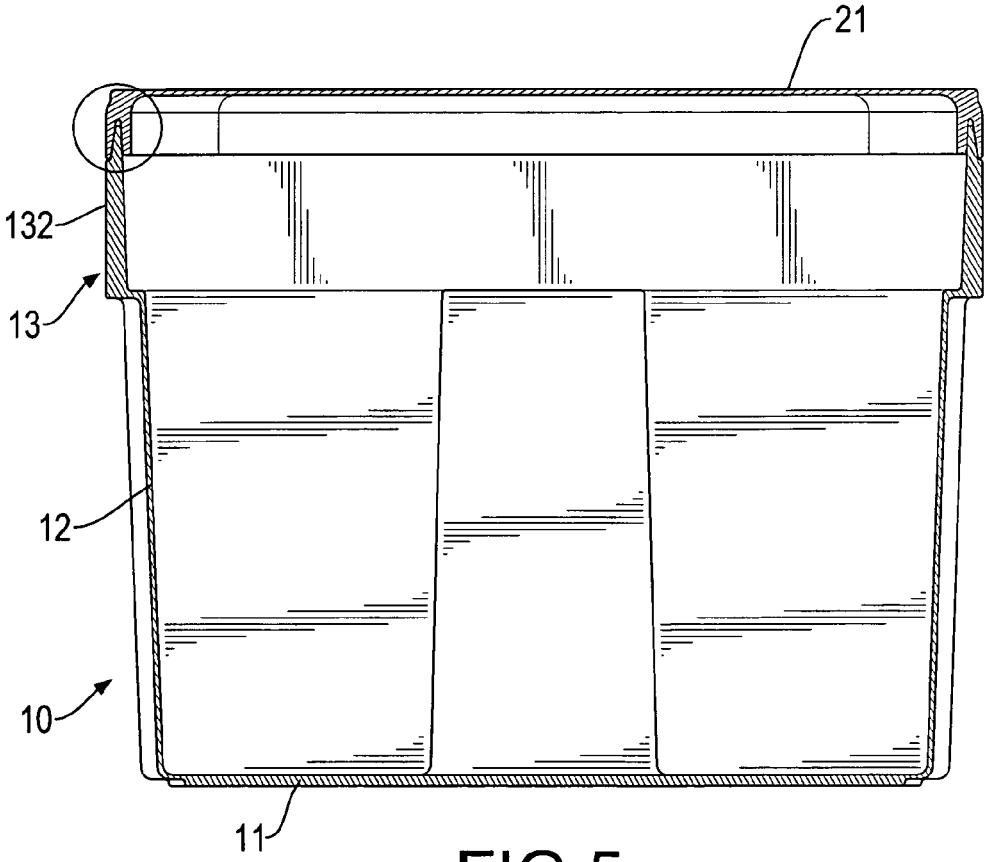
FIG. 5 is a cross-sectional side view of the multi-purpose floatable container in FIG. 1.

With reference to FIG. 5, the casing 10 is hollow and the sealing slot 213 of the cap 21 is elastically engaged with the sealing collar 14 of the casing 10 such that the casing 10 is sealed to prevent air-leakage. The container of the present invention is able to receive food or clothes for moisture-proof or preservation purposes. Furthermore, the container of the present invention is floatable and is provided for survival during flood shortage or tsunami or any other disaster.

Figure 7:
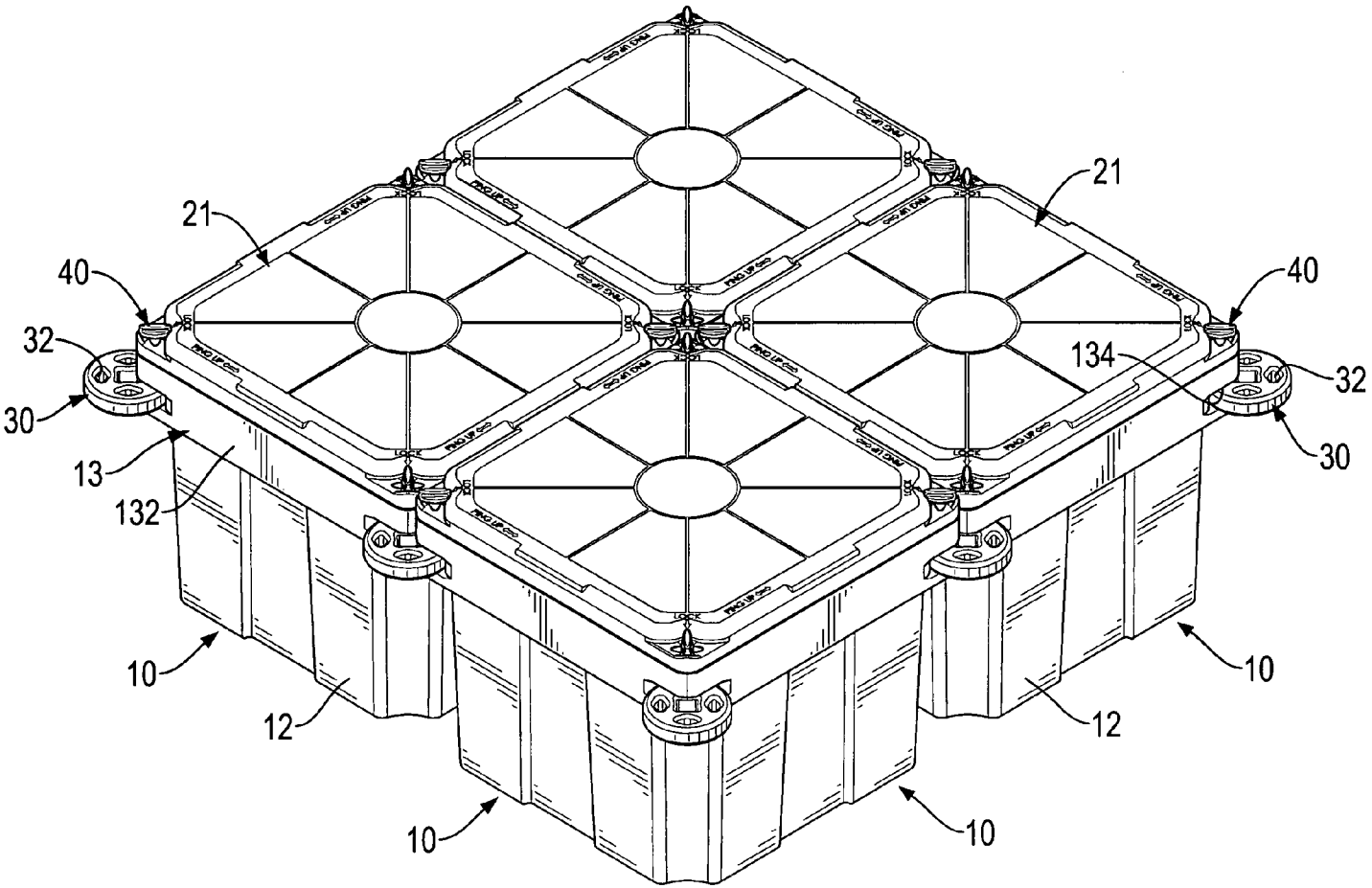
FIG. 7 is a perspective view showing the multiple floatable containers in FIG. 1 being assembled.

Multiple containers of the present invention can be assembled to form a floating platform. With reference to FIG. 7, four containers of the present invention are assembled. The abutting surfaces 132 of the containers are abutted against each other and the linkage disc 30 is positioned in a middle of the four containers. Four buckling bolts 40 are inserted into the linkage disc 30 for combining the four casings 10 and four caps 21 to form a survival floating platform.

Figure 8:
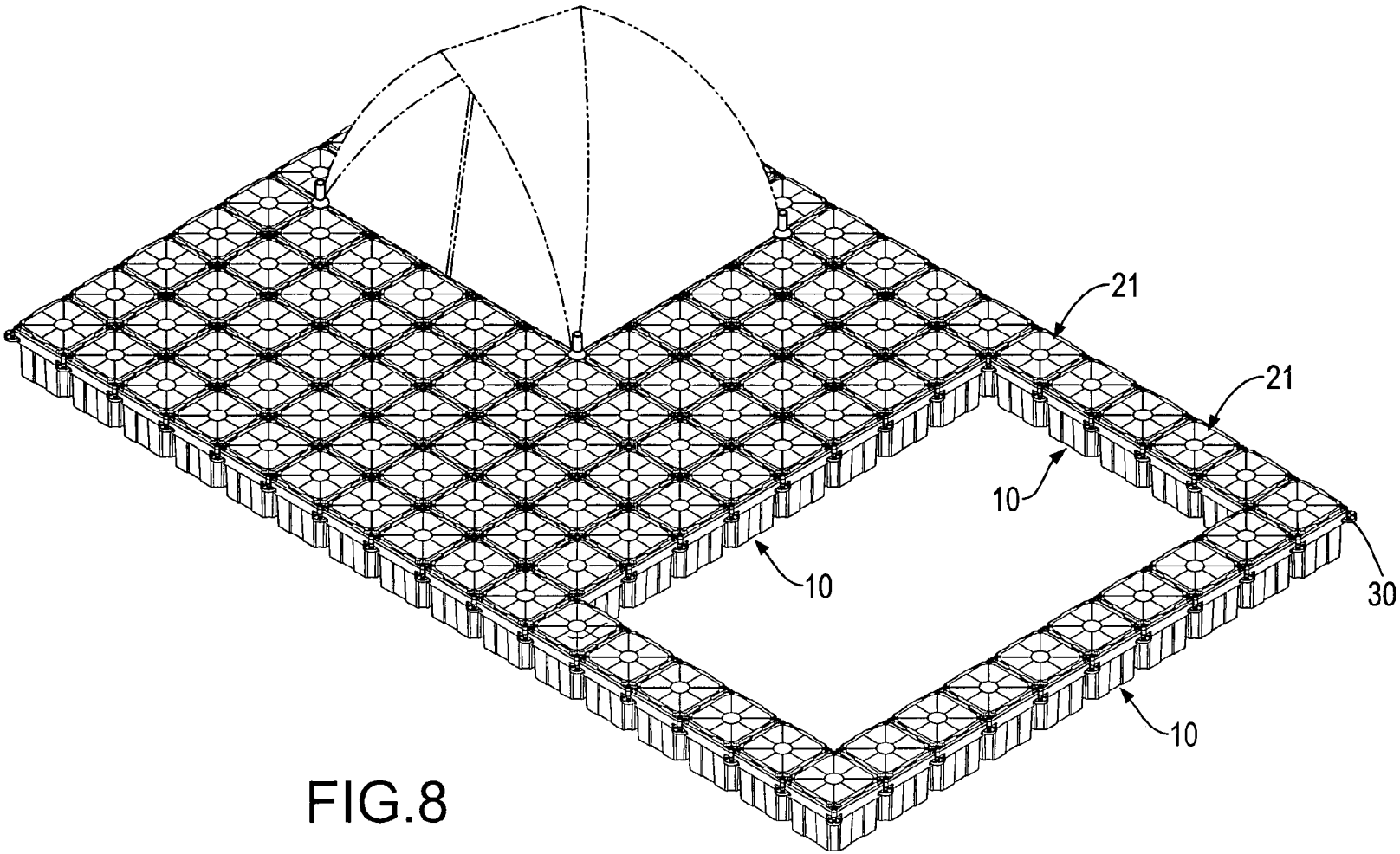
FIGS. 8 and 9 are operational perspective views showing the multiple floatable containers in FIG. 1 being assembled as a platform.
Figure 9:
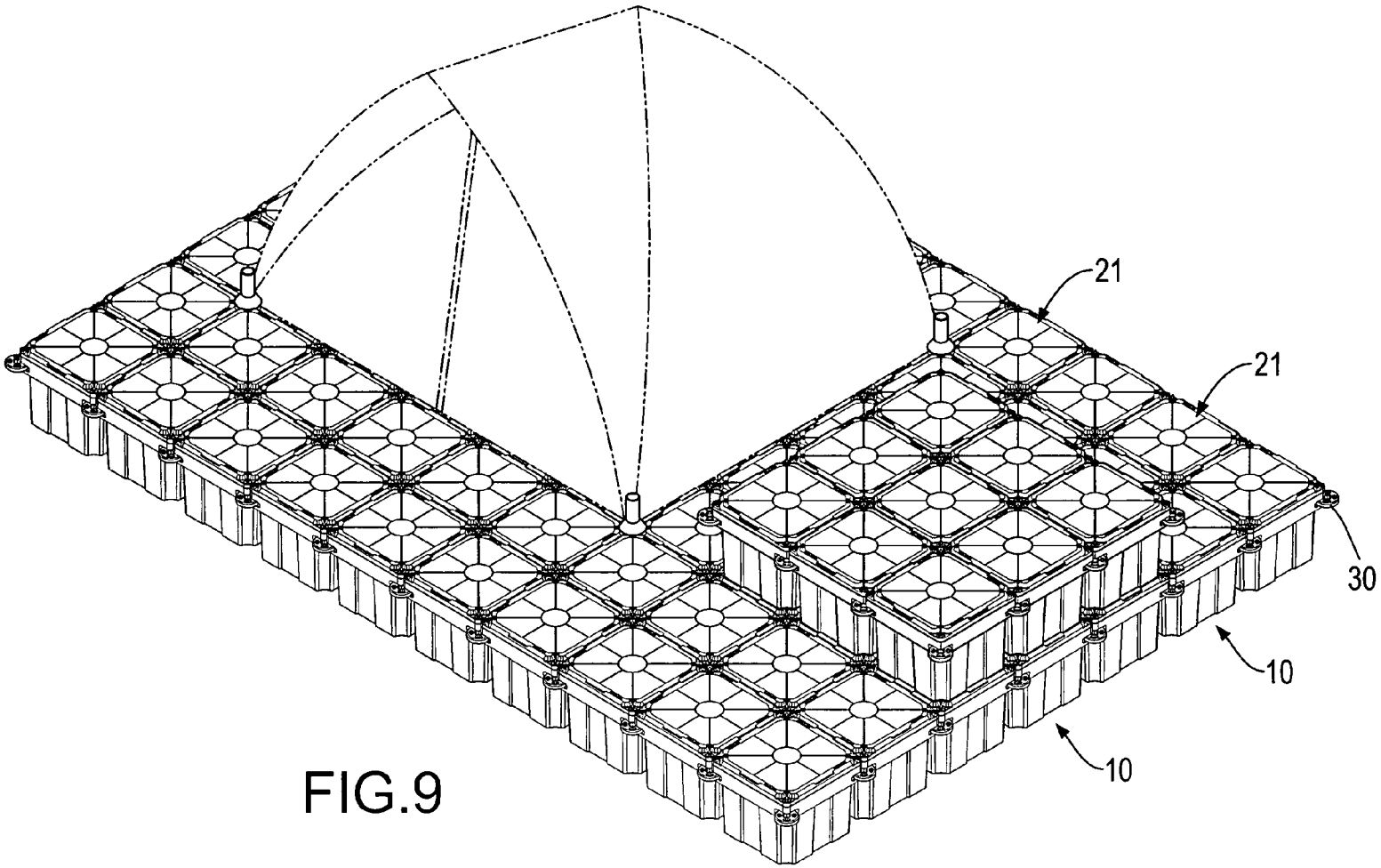

With reference to FIGS. 8 to 9, multiple containers of the present invention can be assembled to form a bigger sized platform or a swimming pool.

Figure 11:
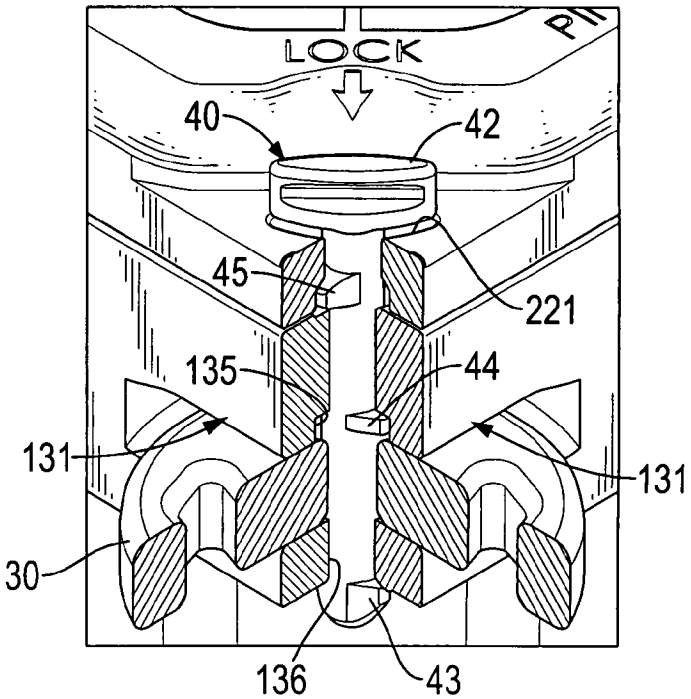
FIGS. 10 to 11 are operational views showing the cap detached from a casing.
Figure 10:
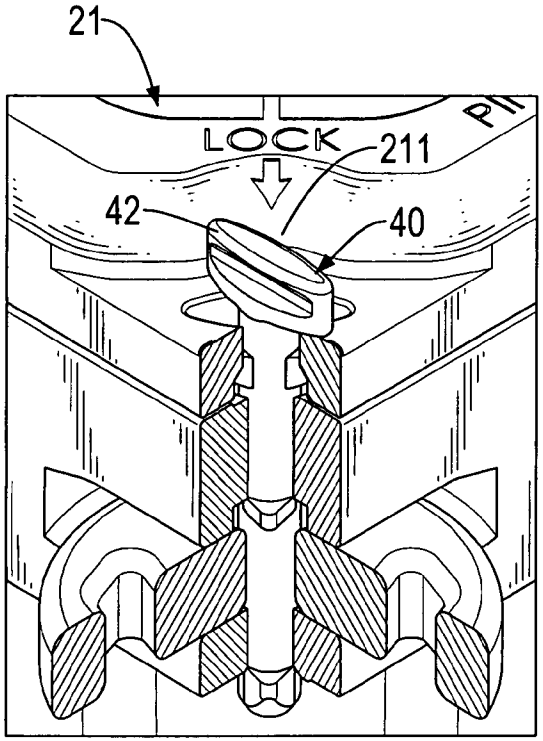
Figure 12:
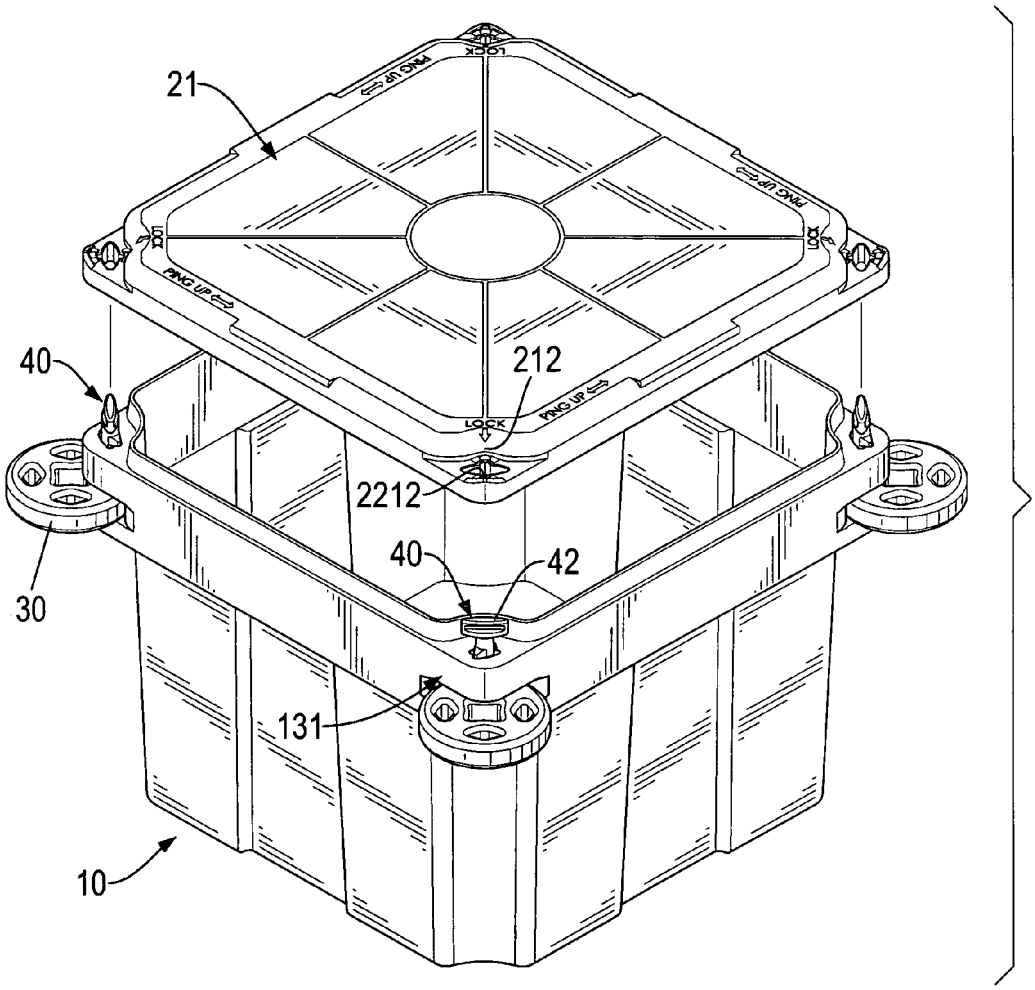
FIG. 12 is an exploded perspective view of the multi-purpose floatable container showing the cap detached from the casing.

With reference to FIGS. 10 to 12, originally, the knob 42 is buckled on the middle part of the depression 211 to prevent the knob 42 from detaching accidentally. When the cap 21 is unsealed, the knob 42 of the buckling bolt 40 needs to be applied with an external force and rotated at ninety degrees. The knob 42 is aligned with the top hole 221 but the upper blocker 45 is not aligned with the two auxiliary holes 2212, such that the buckling bolt 40 cannot be pulled out but the cap 21 is able to be detached.

The bottom blocker 43 and the middle blocker 44 of the buckling bolt 40 are both buckled with the insert portion 131. Even if one of the bottom blocker 43 or the middle blocker 44 is broken, the buckling bolt 40 will not be detached from the insert portion 131. The upper blocker 45 of the buckling bolt 40 is received in the positioning hole 1352 for positioning the buckling bolt 40.

The bottom blocker 43 and the middle blocker 44 of the buckling bolt 40 are not aligned with the lower hole 136 and the upper hole 135 during unsealing of the cap 21. The buckling bolt 40 is kept buckling with the insert portion 131. Therefore, the cap 21 can be detached without influencing the buckling bolt 40 to maintain a connection between containers.

Figure 13:
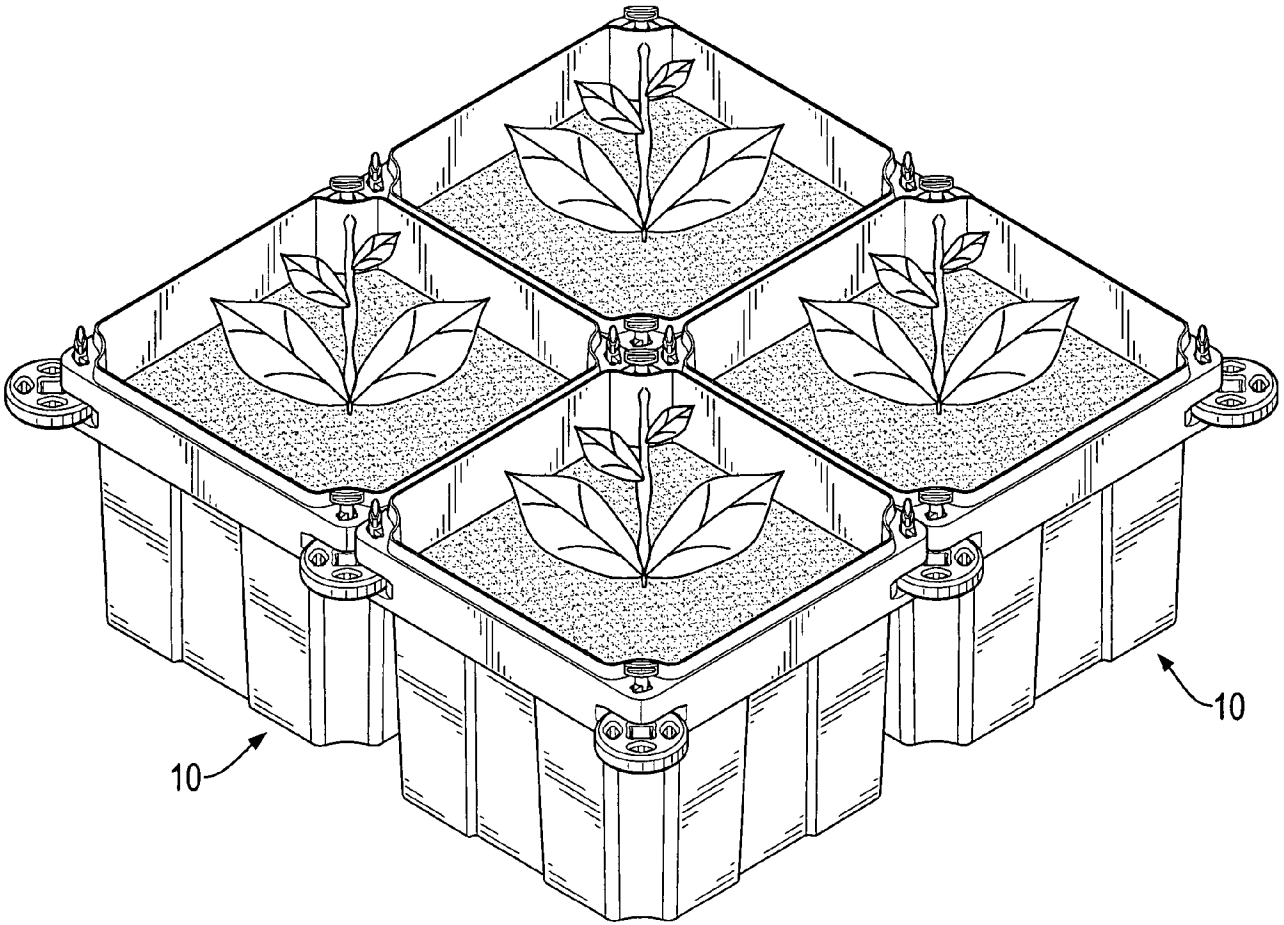
FIG. 13 is an operational perspective view showing the multiple floatable containers in FIG. 1 utilized for plant-cultivation.

With reference to FIG. 13, the container of the present invention is provided for receiving soil for plant-cultivation. The container of the present invention can also be perpendicularly utilized for storing books or tools, functioning as a bookcase or a tool cabinet.

Figure 14:
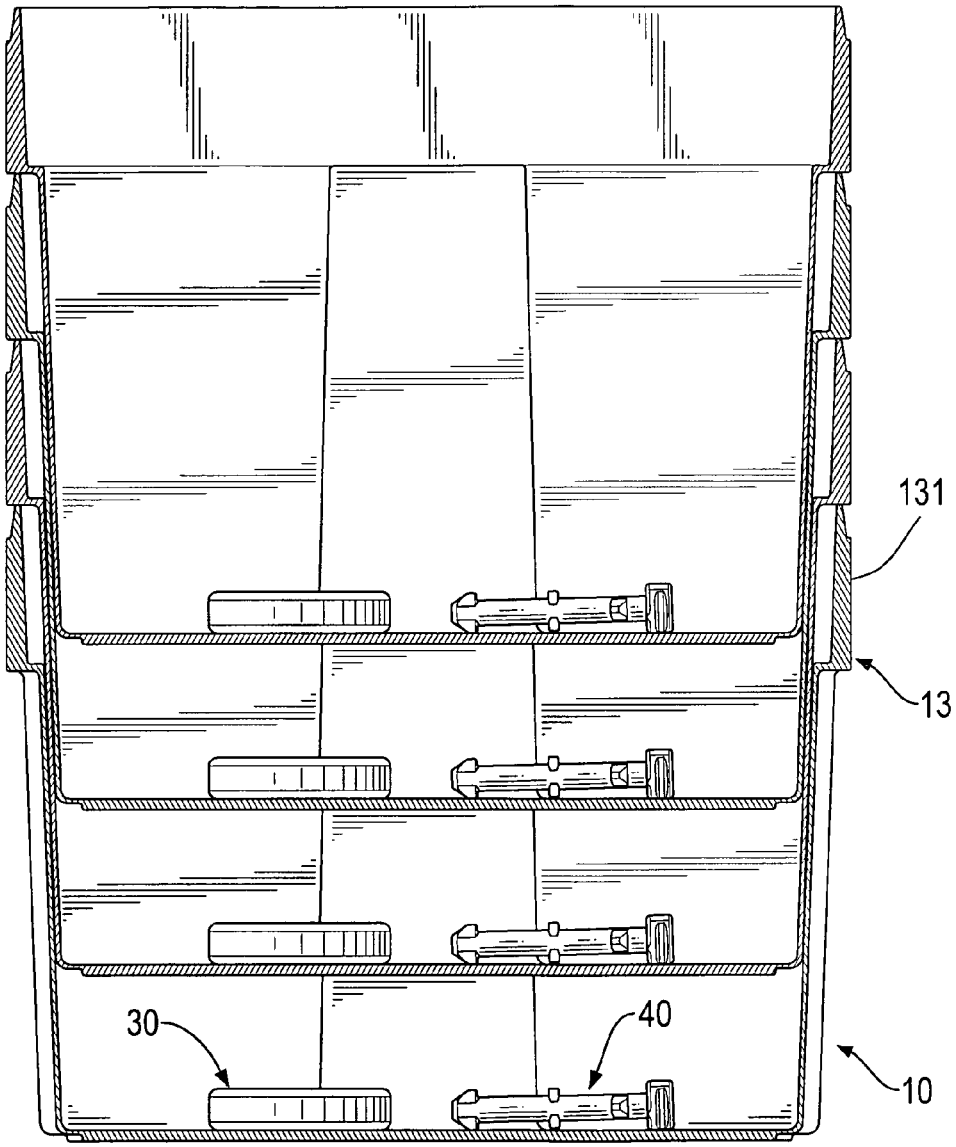
FIG. 14 is an operational side view in partial section showing the multiple floatable containers in FIG. 1 being stacked.

With reference to FIG. 14, the containers can be stacked upon each other. The abutting edge 13 of the casing 10 abuts against the abutting edge 13 of another casing 10 such that a space is defined between the casing 10 and a bottom of another casing 10 for receiving the linkage disc 30 and the buckling bolt 40 for good storage.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-purpose floatable container comprising:

a casing having a bottom plate being in a rectangular shape;

a wall surrounding an edge of the bottom plate and upwardly extending from the bottom plate, and having an abutting edge surroundingly disposed on a top of the wall, outwardly extending from the top of the wall, and being in a rectangular shape such that the abutting edge has four abutting surfaces and four corners including two adjacent corners, each abutting surface disposed between the two adjacent corners of the abutting edge, each corner of the abutting edge having an insert portion formed on the corner, each insert portion having a linking groove;

an upper hole defined through an inner surface of the linking groove; the upper hole having a major axis defined in the upper hole;

an upper enlarged hole defined in the inner surface of the linking groove, located adjacent to the upper hole, and an inner diameter of the upper enlarged hole is equal to or greater than a maximum diameter of the upper hole; and a lower hole defined through the inner surface of the linking groove, aligning with the upper hole, and communicating with the linking groove; the lower hole having a major axis defined in the lower hole; and a rectangle cap mounted on a top of the casing and having four buckling portions respectively disposed on four corners of the cap for corresponding to the four insert portions of the abutting edge, each buckling portion having a top hole aligning with the upper hole of a corresponding one of the insert portions;

two buckling seats formed on two sides surrounding the top hole, respectively located adjacent to a minor axis of the top hole for facing each other; and two slopes respectively formed on two ends of each of the buckling seats; and at least one linkage disc partially and respectively inserted into at least one of the linking grooves, each one of the at least one linkage disc having four connecting orifices for selectively aligning to one of the upper holes, each connecting orifice selectively communicating with the upper hole and the lower hole of one of the insert portions, and at least one buckling bolt mounted on the casing, each one of the at least one buckling bolt inserted into the top hole of one of the buckling portions, the upper hole aligning to the top hole, the connecting orifice of one of the at least one linkage disc aligning to the upper hole, and the lower hole aligning to the upper hole; each one of the at least one buckling bolt having a shank;

an elongated knob disposed on a top of the shank and having two ends radially extending from the buckling bolt toward two opposite directions for selectively buckling the two buckling seats of each of the buckling portions;

an elongated bottom blocker disposed on a bottom of the shank, having two ends radially extending from the shank in opposite directions; and an elongated middle blocker disposed between the bottom blocker and the knob, having two ends radially extending from the shank in opposite directions, such that the middle blocker is able to be received in a corresponding upper enlarged hole for buckling an inner top surface of the upper enlarged hole.

2. The multi-purpose floatable container as claimed in claim 1, wherein the abutting edge has an upwardly extending sealing collar formed as a rectangular shape; the cap further comprising:

four depressions respectively defined in the four corners such that the four buckling portions respectively extend from the four depressions;

an inner collar downwardly extending from a bottom of the cap and surrounding the bottom of the cap; and a sealing slot defined between the inner collar and an inner bottom surface of the cap for tightly receiving the sealing collar.

3. The multi-purpose floatable container as claimed in claim 2, wherein each depression has a middle part inwardly indented for buckling with the knob of a corresponding buckling bolt.

4. The multi-purpose floatable container as claimed in claim 3, wherein each buckling seat protrudes from a corresponding buckling portion such that the slopes of the buckling seat are inclined from the buckling seat toward the corresponding buckling portion.

5. The multi-purpose floatable container as claimed in claim 1, wherein each buckling portion comprises:

a rounded top enlarged hole defined in a bottom of the top hole and communicating with the top hole; and two auxiliary holes respectively defined through the buckling portion, located on two sides surrounding the top hole, and communicating with the top enlarged hole; and, each one of the at least one buckling bolt comprises:

an elongated upper blocker positioned adjacent to the knob, disposed between the knob and the middle blocker, having two ends radially extending from the shank in opposite directions, and having a shape to fit with the two auxiliary holes of the corresponding buckling portion.

6. The multi-purpose floatable container as claimed in claim 5, wherein each of the top holes has a width and a length being greater than a respective width and length of each of the upper holes; each of the auxiliary holes is tapered toward an outer end surrounding the auxiliary hole.

7. The multi-purpose floatable container as claimed in claim 5, wherein each insert portion has an elongated positioning hole, communicating with the upper hole of the insert portion, such that a major axis of the positioning hole and a major axis of the upper hole meet at a 45-degree angle.

* * * * *